United States Patent [19]

Flugger

[11] Patent Number: 4,574,914

[45] Date of Patent: Mar. 11, 1986

[54] COMPACT, SOUND-ATTENUATING MUFFLER FOR HIGH-PERFORMANCE, INTERNAL COMBUSTION ENGINE

[75] Inventor: Ray T. Flugger, Santa Rosa, Calif.

[73] Assignee: Flowmaster, Inc., Sonoma, Calif.

[21] Appl. No.: 548,304

[22] Filed: Nov. 3, 1983

[51] Int. Cl.[4] ..... F01N 1/08

[52] U.S. Cl. ..... 181/268; 181/275; 181/281

[58] Field of Search ..... 181/212, 245, 264, 281, 181/282, 268, 275

[56] References Cited

U.S. PATENT DOCUMENTS

| | | |
|---|---|---|
| 624,062 | 5/1899 | Mattews . |
| 1,081,348 | 12/1913 | Unke . |
| 1,184,431 | 5/1916 | Dodge . |
| 1,677,570 | 7/1928 | Stade . |
| 1,756,916 | 4/1930 | Stranahan . |
| 1,946,908 | 2/1934 | Hanson . |
| 2,071,351 | 2/1937 | McNamara . |
| 2,239,549 | 4/1941 | Chipley . |
| 2,325,905 | 8/1943 | Caulfield . |
| 2,485,555 | 10/1949 | Bester . |
| 2,667,940 | 2/1954 | Gallihugh . |
| 2,934,889 | 5/1960 | Poulos . |
| 2,971,599 | 2/1961 | Tobias . |
| 3,029,895 | 4/1962 | Lyon . |
| 3,029,896 | 4/1962 | Lyon . |
| 3,219,141 | 11/1965 | Williamitis . |
| 3,220,508 | 11/1965 | Nordquest et al. ..... 181/282 X |
| 3,786,896 | 1/1974 | Foster et al. . |
| 4,143,739 | 3/1979 | Nordlie . |
| 4,346,783 | 8/1982 | Scarton et al. . |

*Primary Examiner*—Benjamin R. Fuller

*Attorney, Agent, or Firm*—Manfred M. Warren; Robert B. Chickering; Glen R. Grunewald

[57] ABSTRACT

A compact, sound-attenuating muffler for a high-performance internal combustion engine is disclosed in which the muffler casing has an elongated transverse cross-section with a height dimension of only slightly larger than the height dimension of the inlet exhaust pipe and a width dimension in the range of about 2 to 4½ times the height dimension. The muffler includes a divergently tapering planar first partition which causes gases to be expanded only in a horizontal plane toward the side walls of the muffler and further includes a second partition formed to contract or converge the gases in a horizontal plane toward a central opening. The first partition has a cup-shaped back surface so that contraction of the gases around the back side of the first partition is highly effective in attenuating sound, and both partitions are sloped in a direction toward the outlet from the muffler so as to minimize the generation of back pressure, which is not substantially greater than the back pressure in a straight pipe.

7 Claims, 3 Drawing Figures

COMPACT, SOUND-ATTENUATING MUFFLER FOR HIGH-PERFORMANCE, INTERNAL COMBUSTION ENGINE

BACKGROUND OF THE INVENTION

Numerous muffler constructions have been proposed for the attenuation of the sound component of an exhaust gas stream from an internal combustion engine. Invariably, these structures have purported to effect sound attenuation without substantially or intolerably increasing the back pressure on the engine. As is well known, muffler induced back pressure will substantially reduce internal combustion engine performance. The problem of reduced performance is most extreme in high-performance racing engines. The "solution" to the problem which is actually used usually is merely to employ a straight pipe from the engine and tolerate the noise. With urban expansion, however, even race tracks are under pressure to reduce the noise level during racing. Moreover, at least some high performance cars also are driven, at least occasionally, on the city streets. In order to be "street-legal" such high performance engines must be coupled to a muffler, and the only mufflers which are currently commercially available that are used on such high-performance engines cause a significant drop in engine power as a direct result of the back pressure induced in the muffler.

Typically, a 575 horsepower engine will produce a noise level of about 130 db at hard acceleration with no muffler, and on the same engine when a commercially available high-performance muffler is used, the noise level will be reduced to about 95 db (A scale) at hard acceleration, but there also will be an 18 to 20% power loss. Even larger engines, for example 700 to 800 horsepower, have more cam overlap and cannot tolerate sound attenuation to 95 db since it would produce a 30 to 40% power loss.

Another problem that complicates any attempt to attenuate sound in high-performance internal combustion engines is the necessity to minimize bulk and weight. The exhaust pipe on a high horsepower engine typically will be about 4 inches in diameter so as to accommodate the very substantial volumetric flow. Mufflers which depend upon excessive length or diameter to achieve sound attenuation will be unsuitable for use on race cars, either because of their bulk or weight, or both.

The patent art contains various muffler constructions which purport to solve the problem of sound attenuation without undesirable back pressure, but in fact these various structures have substantial performance deficiencies. It is well known to provide a divergently tapered centrally located conical partition for flow of gases around the partition to effect an expansion of the gases. Typical of such structures are the devices shown in U.S. Pat. Nos. 2,071,351, 2,239,549 and 2,971,599.

Some of these patented mufflers follow such an expansion partition or cone with a contraction or concentrating partition or baffle. Typical of such devices are the mufflers shown in U.S. Pat. Nos. 1,081,348, 2,667,940, 3,029,895 and 3,029,896. These mufflers, however, do significantly increase back pressure by causing the exhaust gases to reverse the direction of their flow axially as they attempt to pass beyond the concentrating or converging baffle. This flow reversal may be effective in sound attenuation, but it has been found to increase back pressure undesirably.

Even mufflers which employ alternating divergent and then convergent partitions have suffered from undesirable bulk and/or weight, inordinate complexity, or auxiliary flow channels or openings in the partitions which defeat sound attenuation. Typical of such mufflers are the mufflers set forth in U.S. Pat. Nos. 624,062, 1,184,431, 2,325,905 and 2,485,555.

Additional patent art known to applicant but believed to be peripheral in relevance to the present invention are the following U.S. Pat. Nos. 1,677,570, 1,756,916, 1,946,908, 2,934,889, 3,219,141, 3,786,896, 4,143,739 and 4,346,783.

The reality of the industry is that high-performance racing cars are either using no muffler or mufflers which barely achieve the desired sound attenuation, and achieve it at a significant power loss and with an undesirable increase in bulk and weight.

OBJECTS AND SUMMARY OF INVENTION

A. Objects of Inventions

Accordingly, it is an object of the present invention to provide a compact, lightweight, sound-attenuating muffler for a high-performance internal combustion engine or the like which achieves sound attenuation without significant decrease in engine performance.

It is another object of the present invention to provide a highly effective sound-attenuating muffler for a high-performance, internal combustion engine which is simple to construct, is compact, can be used on race cars or the like, is durable and is lightweight.

The compact, sound-attenuating muffler of the present invention has other objects and features of advantage which will become apparent from and are set forth in more detail in the following description of the preferred embodiment and the accompanying drawing.

B. Summary of the Invention

The compact, sound-attenuating muffler of the present invention includes a casing having an inlet opening formed for the flow of exhaust gases into the casing and an outlet opening formed for the discharge of gases from the casing. The muffler also includes partition means positioned in the casing and including a divergently tapered first partition formed to deflect gases toward side walls of the casing, and a convergently tapered second partition positioned downstream of the first partition and formed with a central opening therein for convergence of gases from the side walls to the opening. The improvement in the muffler of the present invention comprises, briefly, a muffler in which a casing is formed with a transverse cross-section having a width dimension substantially greater than the height dimension, the first partition is formed to extend and to be imperforate over the full height dimension of the casing and is formed to terminate short of the full width of the casing to define a pair of openings proximate opposite side walls of the casing, and the second partition is formed to extend across both the width and height dimensions of the casing and being imperforate intermediate the casing walls except for the central opening. In the preferred form, the height dimension of the casing is only slightly greater than the height dimension of the inlet opening to the casing, and the width dimension is at least about twice the height dimension for expansion and contraction of exhaust gases in substantially a single plane. In order to achieve attenuation, the divergent partition includes an extension section, and in order to minimize back pressure the convergent partition preferably converges at a slope with respect to the side walls of the casing in the range of about 45° to about 70°.

DESCRIPTION OF THE PREFERRED EMBODIMENT

Figure 1:
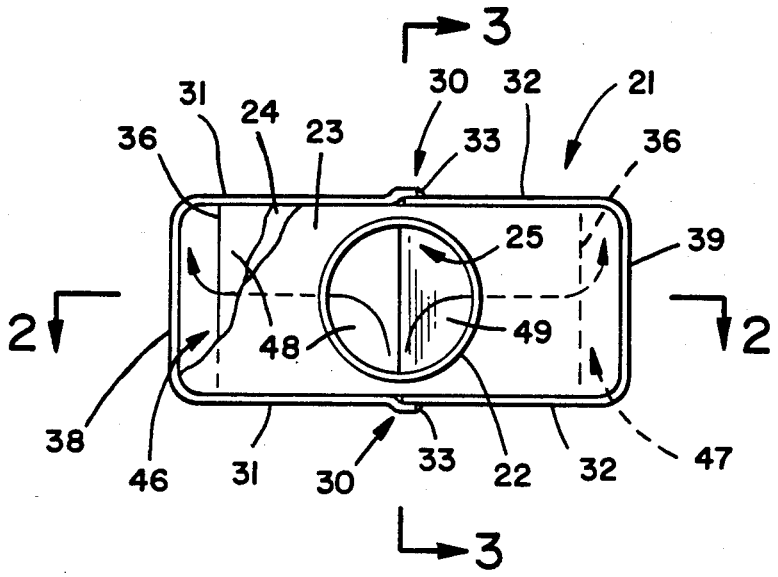
FIG. 1 is a front elevational view of a muffler constructed in accordance with the present invention.

The muffler for high-performance, internal combustion engines of the present invention can be seen in the drawing to include a casing, generally designated 21, an inlet pipe 22 extending through casing end wall members 23 and 24 for the flow of exhaust gases through inlet opening 25 into casing 21. The muffler further includes an outlet pipe 26 mounted to extend through casing end wall 27 and provide an outlet opening 28 for the discharge of gases from the casing. Mounted in casing 21 is partition means, generally designated 29, which is formed for the attenuation of the sound component in the exhaust gases as the gases pass through the muffler, as will be described hereinafter in more detail.

In order to facilitate fabrication of a high-strength, durable muffler, casing 21 is preferably formed from longitudinally extending casing halves 31 and 32 which are joined together along longitudinally extending upper and lower seams 30, for example, by welding at 33. Casing end wall members 23, 24 and 27 are similarly welded to the ends of casing halves 31 and 32, and the inlet and outlet exhaust pipes 22 and 26 are in turn welded to the respective end walls of the casing. During the assembly process, partitions means 29, each of which includes flanges 34, can be inserted into assembled casing halves and welded in place.

The construction of muffler casing 21 as above described affords a structure which is very rigid and durable and accordingly capable of withstanding the substantial stresses inherent in high-performance muffler operation.

Figure 2:
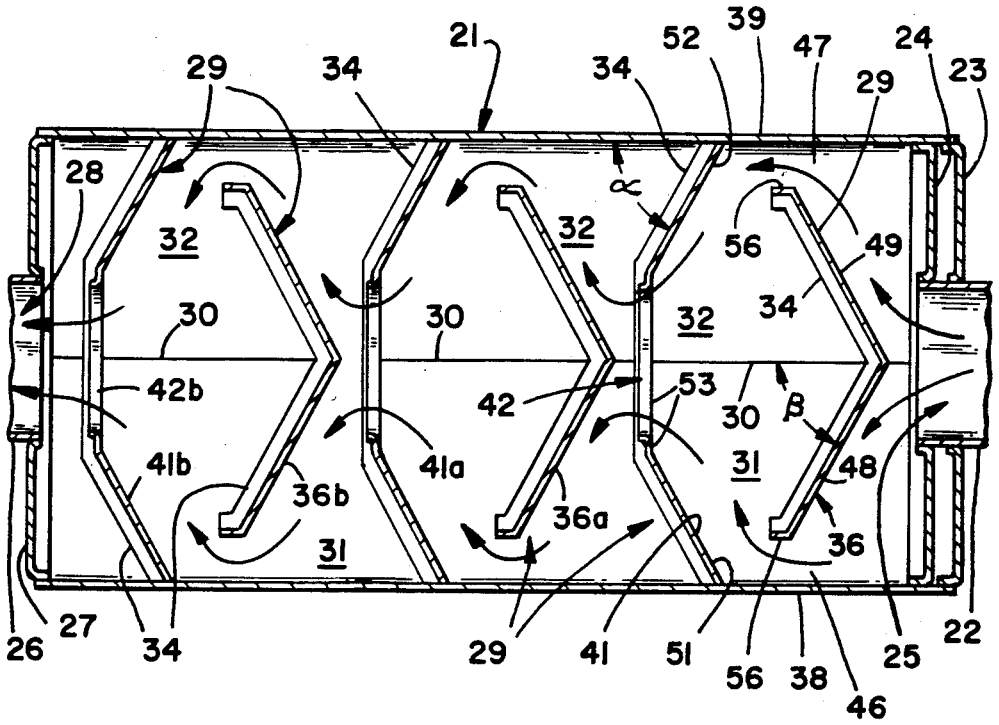
FIG. 2 is a top plan view, in cross-section, taken substantially along the plane of line 2—2 in FIG. 1.

As best may be seen in FIG. 2, partition means 29 includes a first partition 36 which is divergently tapered from the longitudinal center line of the casing, which coincides with seam 30 between casing halves 31 and 32. First partition 36 deflects gases passing through inlet opening 25 from inlet exhaust pipe 22 outwardly toward the side walls 38 and 39 of casing 21. Mounted downstream of partition 36 is a second partition 41 which is formed to be convergently tapered with respect to the central longitudinal axis of the muffler. Partition 41 is formed with central opening means 42 so that gases converging from walls 38 and 39 pass through central opening 42, at which point they are discharged from the casing or, as shown in the drawing, impact an additional first partition 36*a*. In the muffler shown in the drawing, the divergence and convergence of the exhaust stream is repeated when the exhaust gases are successfully deflected by an additional second partition 41*a*, still another first partitions 36*a* and finally an additional second partition 41*b*, which discharges the gases through opening 42*b* into outlet opening 28 and outlet exhaust pipe 26.

The successive outward deflection and then inward convergence of gases in a muffler is broadly known in the prior art. Such prior art structures, however, typically have partitions or baffle structures which induce undesirable back pressure, contain openings or passageways which diminish the sound attenuating effectiveness of the muffler, or require excessive length, diameter and/or weight.

The muffler of the present invention achieves extremely effective sound attenuation without undesirable back pressure and bulk or weight by forming casing 21 with a transverse cross section having a width dimension substantially greater than the height dimension. As used herein, the terms "width" and "height" refer to the muffler as oriented in FIG. 1. It will be understood, however, that the muffler of the present invention can be installed and oriented at 90° from the orientation shown in FIG. 1, or at any desired angle with respect to inlet pipe 22. Regardless of the orientation, however, the muffler casing or housing is formed with an elongated transverse cross-section.

Figure 3:
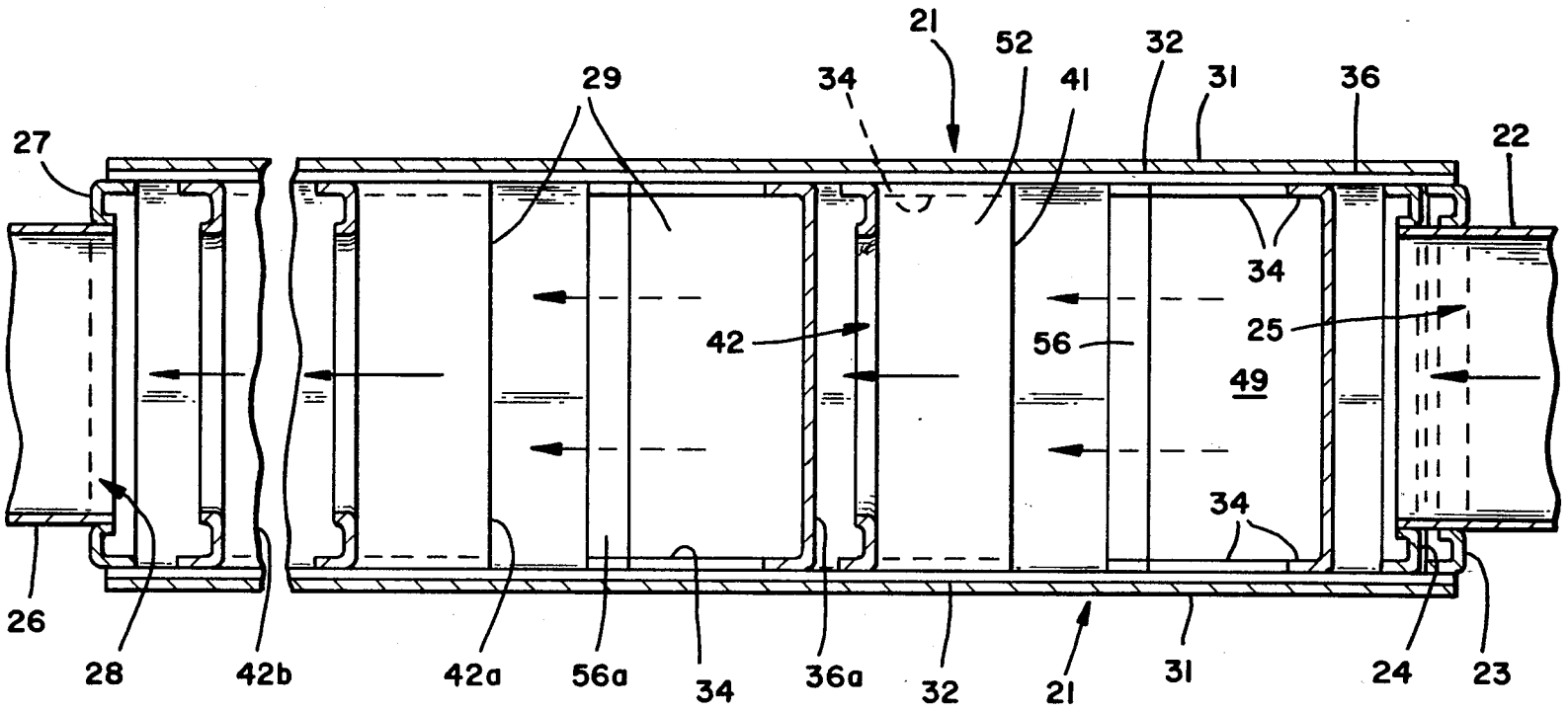
FIG. 3 is an enlarged, side-elevational view, in cross section, taken substantially along the plane of line 3—3 in FIG. 1.

As best may be seen in FIGS. 1 and 3, the height dimension of the casing is not substantially greater than the height dimension of inlet tube or pipe 22, while it is preferable that the width dimension of the casing be sufficient to such that the expansion ratio between the area of inlet pipe 22 and the cross-sectional area of the inside of the housing is in the range of about 1 to 3, as a minimum, and 1 to 8, as a maximum. This can be accomplished if the width dimension is at least about twice the height dimension of the casing but not more than about 4.5 times the height dimension. In the preferred form, an expansion ratio between the area of inlet tube 22 and the internal transverse cross-sectional area of casing 21 is about 1 to 4, with the width dimension being about 2.4 times the height dimension.

In order to achieve the necessary expansion of gases, it is preferable that first partition 36 be formed as a solid imperforate member which extends over th full height dimension of the casing and yet does not extend over the full width dimension. Instead, partition 36 terminates short of the side casing walls 38 and 39 so as to define a pair of openings 46 and 47 proximate the opposite side walls of the casing. Additionally, instead of forming first partition 36 as a conical partition, as so customarily is employed in the prior art, the first partition is provided by a pair of divergently tapering planar surfaces 48 and 49 oriented in substantially vertical planes and connected at an apex positioned at substantially the center of the stream of exhaust gases discharged into the muffler through inlet pipe 22. This construction of first partition 36 produces expansion in substantially one plane, namely, the horizontal plane, as viewed in FIG. 1.

Second partition 41 is formed to extend across both the width and height dimensions of the casing and is further formed to be imperforate intermediate the casing walls except for central opening means 42. Thus, all of the exhaust gases are forced to converge around the back side of cup-shaped first partition 36 toward central opening 42 in the second partition. There are no auxiliary pathways or openings in the second partition which will allow sound to pass directly along the casing walls. Again, instead of providing a conical or frustoconical member, second partition 41 is provided by a pair of convergently tapered planar surfaces 51 and 52 oriented in vertical planes and connected to a central planar surface 53 formed with opening 42 therein. Gases, therefore, converge in substantially a single plane, the horizontal plane.

In order to avoid undesirable back pressure in the muffler while limiting the overall muffler length and accordingly bulk and weight, the converging planar surfaces 51 and 52 converge at a slope with respect to the side walls of the casing in the range of about 45 degrees to about 70 degrees. Thus, angle $\alpha$ should not be greater than 70 degrees or else a substantial increase in back pressure is produced, and the angle also should not be less than 45° or else the overall length and weight of the muffler will be undesirably increased. By way of illustration, the back pressure in the muffler is increased by 3 to 4 times when the angle $\alpha$ is increased from about 65° to about 80°.

Similarly, in order to minimize back pressure and limit the overall muffler length, it is preferable that planar surfaces 48 and 49 in first partition 36 diverge at an angle $\beta$ which is equal to between about 45° and about 70°.

In order to further enhance sound and attenuation, the muffler of the present invention preferably includes a first partition which is formed with extension means 56 at the edges thereof defining openings 46 and 47. The extension means extends along the longitudinal axis of the casing substantially parallel to the casing walls to define passageways along the casing and a cup-shaped back side of the first partition. It has been found that the addition of extension means 56 to first partition 36 attenuates the sound by about 20 to 30%, as compared to a first partition without the extension means. Although increasing the length of the extension means does increase sound attenuation to some degree, it also increases the overall length of the muffler. Even a short extension means produces a substantial sound attenuation over a first partition formed without the extension. Thus, in a 12-inch (30.5 cm) wide muffler extension means 56 need only have a length of ½ to ¾ inches (1.3 to 1.9 centimeters).

As will be seen from the drawing, the muffler of the present invention includes three sets of first and second partitions. Each set of partitions will attenuate the sound component in the exhaust gases by about ½ to ⅔ of the sound level in the incoming gases. Three sets of partitions can be used to reduce the sound level on an 800 horsepower engine during maximum acceleration from about 130 db on the A scale (about 5,000 watts) to about 90 db on the A scale (about one tenth of a watt). The back pressure generated by the muffler as shown in the drawings on an 800 horsepower engine will produce less than 2% power loss, with the back pressure being in the range of ½ to 1 psi, as compared to commercially available high-performance mufflers which typically will produce a back pressure of between 15 and 20 psi and a 15 to 20% power loss.

What is claimed is:

1. A compact, sound-attenuating muffler for a high-performance, internal combustion engine or the like including a casing having an inlet opening formed for the flow of exhaust gases into said casing and an outlet opening formed for the discharge of gases from said casing, and partition means positioned in and supported from said casing including a divergently tapered first partition formed to deflect gases toward side walls of said casing, and a convergently tapered second partition positioned in and supported from said casing downstream of said first partition and formed with central opening means therein for convergence of gases from said side walls to said opening, wherein the improvement in said muffler comprises:

said casing being formed with a transverse cross-section having a width dimension substantially greater than the height dimension;

said first partition being an imperforate member formed to extend over the full height dimension of said casing and being formed to terminate short of the full width dimension of said casing to define a pair of openings proximate opposite side walls of said casing; and said second partition being formed to extend across both the width and height dimensions of said casing and being imperforate intermediate said casing walls except for said central opening means.

2. A compact, sound-attenuating muffler for a high-performance, internal combustion engine or the like, said muffler including a casing having an inlet opening and an outlet opening, a divergently tapered first partition positioned in and supported from said casing and formed to deflect exhaust gases flowing in said casing proximate said inlet opening outwardly toward side walls of said casing, said first partition terminating short of said side walls for flow of said gases therebetween, and a convergently tapered second partition positioned in and supported from said casing immediately proximate and downstream of said first partition and formed with a central opening means for inward convergence of the flow of said gases from said side walls toward side central opening means, wherein the improvement in said muffler comprises:

said first partition being formed and positioned relative to said gases flowing in said casing proximate said inlet opening to divide said gases into two separate and distinct streams and being formed to deflect said streams toward opposite side walls of said casing, said first partition terminating short of said opposite side walls to define a pair of relatively narrow elongated openings therebetween having substantially parallel longitudinal axes, said first partition being imperforate and extending across said casing intermediate said elongated openings; and said second partition being imperforate proximate said opposite side walls and being formed to deflect said streams toward said central opening means and toward each other for intersection of said streams while in substantially the same plane from opposite directions proximate said central opening means behind said first partition.

3. The compact, sound-attenuating muffler as defined in claim 2 wherein, said first partition is provided by a pair of divergently tapering planar surfaces extending completely across said casing in one direction and terminating short of said opposed side walls in a second direction substantially perpendicular to said one direction said surfaces being connected at an apex positioned substantially at the center of a stream of said gases in said muffler to divide said gases into two streams of substantially equal volume, said first partition being further formed with a concave back surface opposite said central opening means in said second partition.

4. The compact, sound-attenuating muffler as defined in claim 3 wherein, said first partition is formed with extension means at edges thereof defining said elongated openings, said extension means extending along the longitudinal axis of said casing substantially parallel to said opposite side walls to define passageways along said casing and a cup-shaped configuration on the back side of said first partition in front of said second partition.

5. The compact, sound-attenuating muffler as defined in claim 3 wherein, said second partition is provided by a pair of convergently tapering planar surfaces connected to a central planar surface formed with said central opening means therein.

6. The compact, sound-attenuating muffler as defined in claim 5 wherein, said casing has a height dimension not substantially greater than the height dimension of said inlet opening for expansion and contraction of gases in said casing around said partitions solely in the width dimension, said elongated openings being elongated in the height dimension.

7. The compact, sound-attenuating muffler as defined in claim 6 wherein, said first partition is formed to diverge and said second partition is formed to converge at an angle in the range of about 45° to about 70°; and said casing has a height dimension not substantially greater than the height dimension of said inlet opening and a width dimension in the range of about 2.0 to 4.5 times the height dimension.

* * * * *

REEXAMINATION CERTIFICATE (1599th)

United States Patent [19] [11] B1 4,574,914

Flugger [45] Certificate Issued Dec. 3, 1991

[54] COMPACT, SOUND-ATTENUATING MUFFLER FOR HIGH-PERFORMANCE INTERNAL COMBUSTION ENGINE

[75] Inventor: Ray T. Flugger, Santa Rosa, Calif.

[73] Assignee: Flowmaster, Inc.

Reexamination Request:
No. 90/002,301, Mar. 21, 1991

Reexamination Certificate for:

| | |
|---|---|
| Patent No.: | **4,574,914** |
| Issued: | **Mar. 11, 1986** |
| Appl. No.: | **548,304** |
| Filed: | **Nov. 3, 1983** |

[51] Int. Cl.[5] ..... F01N 1/08

[52] U.S. Cl. ..... 181/268; 181/275; 181/281

[58] Field of Search ..... 181/268, 275, 281, 212, 181/245, 264, 282, 247, 264, 265, 270, 282

[56] References Cited

FOREIGN PATENT DOCUMENTS 316875 12/1919 Fed. Rep. of Germany .
285604 2/1928 United Kingdom .

*Primary Examiner*—L. T. Hixon

[57] ABSTRACT

A compact, sound-attenuating muffler for a high-performance internal combustion engine is disclosed in which the muffler casing has an elongated transverse cross-section with a height dimension of only slightly larger than the height dimension of the inlet exhaust pipe and a width dimension in the range of about 2 to 4½ times the height dimension. The muffler includes a divergently tapering planar first partition which causes gases to be expanded only in a horizontal plane toward the side walls of the muffler and further includes a second partition formed to contract or converge the gases in a horizontal plane toward a central opening. The first partition has a cup-shaped back surface so that contraction of the gases around the back side of the first partition is highly effective in attenuating sound, and both partitions are sloped in a direction toward the outlet from the muffler so as to minimize the generation of back pressure, which is not substantially greater than the back pressure in a straight pipe.

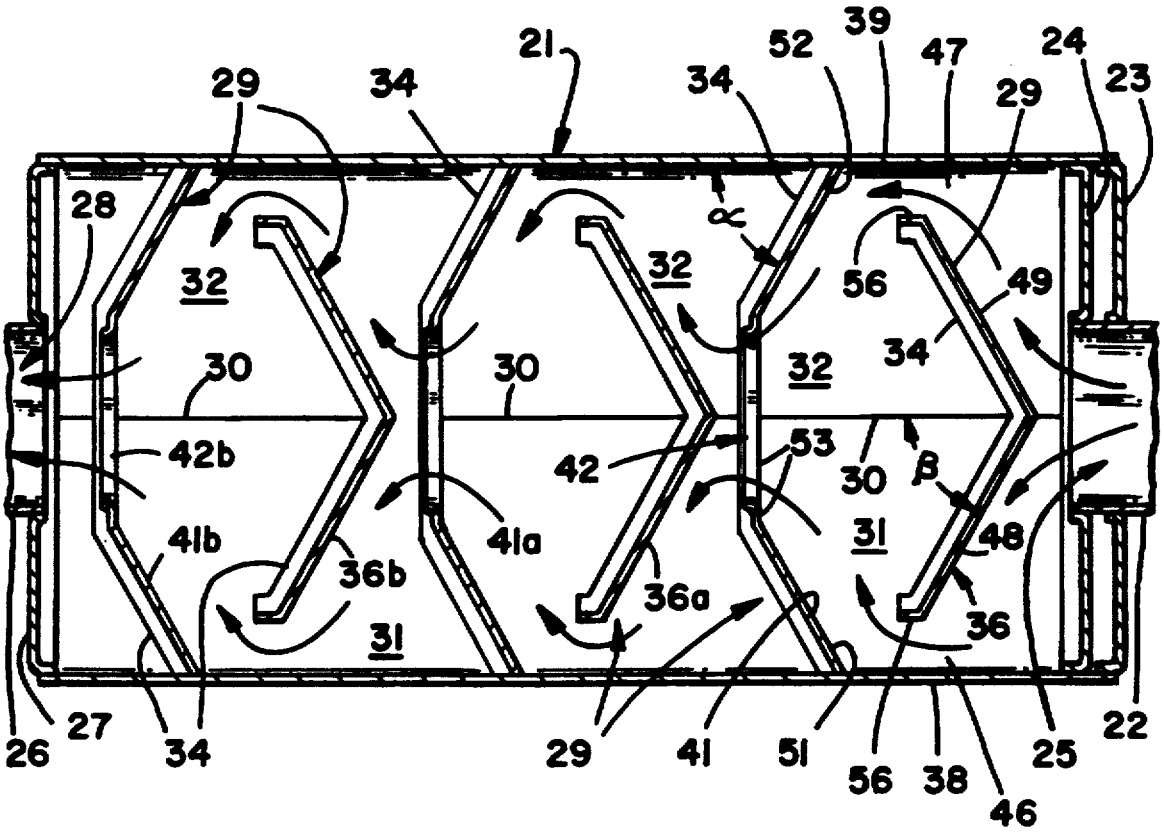

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

ONLY THOSE PARAGRAPHS OF THE SPECIFICATION AFFECTED BY AMENDMENT ARE PRINTED HEREIN.

Column 4, lines 11-23:

The muffler of the present invention achieves extremely effective sound attenuation without undesirable back pressure and bulk or weight by forming casing 21 with a transverse cross section having a width dimension substantially greater than the height dimension. As used herein, the terms "width" and "height" refer to the muffler as oriented in FIG. 1. It will be understood, however, that the muffler of the present invention can be installed and oriented at 90° from the orientation shown in FIG. 1, or at any desired angle with respect to inlet pipe 22. Regardless of the orientation, however, the muffler casing or housing is formed with an elongated transverse cross-section , *and it will be seen from FIGS. 1 and 2 that the transverse cross sectional area of the casing remains substantially constant over the length of the casing.*

Column 4, lines 57-68 Column 5, lines 1-4:

Second partition 41 is formed to extend across both the width and height dimensions of the casing and is further formed to be imperforate intermediate the casing walls, except for central opening means 42. Thus, all of the exhaust gases are forced to converge around the back side of cup-shaped first partition 36 toward *a substantially circular* central opening 42 in the second partition. There are no auxiliary pathways or opening in the second partition which will allow sound to pass directly along the casing walls. Again, instead of providing a conical or frustoconical member, second partition 41 is provided by a pair of convergently tapered planar surfaces 51 and 52 oriented in vertical planes and connected to a central planar surface 53 formed with opening 42 therein. Gases, therefore, converge in substantially a single plane, the horizontal plane.

AS A RESULT OF REEXAMINATION, IT HAS BEEN DETERMINED THAT:

Claims 1, 2, 3 and 4 are determined to be patentable as amended.

Claims 5, 6 and 7 dependent on an amended claim, are determined to be patentable.

New claim 8 is added and determined to be patentable.

1. A compact, sound-attenuating muffler for a high-performance, internal combustion engine or the like [including] *comprising:* a casing having *a length and* an inlet opening formed for the flow of exhaust gases into said casing and an outlet opening formed for the discharge of gases from said casing, and partition means positioned in and supported from said casing including a divergently tapered first partition formed to deflect gases toward side walls ofsaid casing, and a convergently tapered second partition positioned in and supported from said casing down-stream of said first partition and formed with central opening means therein for convergence of gases from said side walls to said opening[, wherein the improvement in said muffler comprises:]*;* said casing being formed with a transverse cross-section having a width dimension substantially greater than the height dimension;

said first partition being an imperforate member formed to extend over the full height dimension of said casing and being formed to terminate short of the full width dimension of said casing to define a pair of openings proximate opposite side walls of said casing; [and]

said second partition being formed to extend across both the width and height dimensions of said casing and being imperforate intermediate said casing walls except for said central opening means[.]*; and said transverse cross-section of said casing having an area which is substantially constant over said length of said casing.*

2. A compact, sound-attenuating muffler for a high-performance, internal combustion engine or the like, [said muffler including] *comprising:* a casing having an inlet opening and an outlet opening *and having a transverse cross-section with a width dimension and a height dimension, said casing having a length dimension orthogonal to said width dimension and said height dimension*, a divergently tapered first partitionpositioned in and supported from said casing and formed to deflect exhaust gases flowing in said casing proximate said inlet opening outwardly toward side walls of said casing, said first partition terminating short of said side walls for flow of said gases therebetween, and a convergently tapered second partition positioned in and supported from said casing immediately proximate and downstream of said first partition and formed with a central opening means for inward convergence of the flow of said gases from said side walls toward side central opening means[, wherein the improvement in said muffler comprises:]*;* said first partition being formed and positioned relative to said gases flowing in said casing proximate said inlet opening to divide said gases into two separate and distinct streams and being formed to deflect said streams toward opposite side walls of said casing, said first partition terminating short of said opposite side walls to define a pair of relatively narrow elongated openings therebetween having substantially parallel longitudinal axes, said first partition being imperforate and extending across said casing intermediate said elongated openings; [and]

said second partition being imperforate proximate said opposite side walls and being formed to deflect said streams toward said central opening means and toward each other for intersection of said streams while in substantially the same plane from opposite directions proximate said central opening means behind said first partition [.]; *and said casing having said width dimension and said height dimension respectively substantially constant throughout said length dimension of said casing.*

3. The compact, sound-attenuating muffler as defined in claim 2 wherein, said first partition is provided by a pair of divergently tapering planar surfaces extending completely across said casing in one direction and terminating short of said opposed side walls in a second direction substantially perpendicular to said one direction, said surfaces being connected at an apex positioned substantially at the center of a stream of said gases in said muffler to divide said gases into two streams of substantially equal volume, said first partition being further formed with a concave back surface opposite said central opening means in said second partition.

4. The compact, sound-attenuating muffler as defined in claim 3 wherein, said first partition *has a thickness dimension and* is formed with extension means at edges thereof defining said elongated openings, said extension means extending along the longitudinal axis of said casing substantially parallel to said opposite side walls *and having a dimension along said longitudinal axis greater than said thickness dimension of said first portion* to define passageways along said casing and a cup-shaped configuration on the back side of said first partition in front of said second partition.

*8. In a compact, sound-attenuating muffler for a high-performance, internal combustion engine or the like including a casing having an inlet opening formed for the flow of exhaust gases into said casing, an outlet opening formed for the discharge of gases from said casing, said casing having a transverse cross-section with a width dimension and a height dimension, and said casing having a length dimension orthogonal to said width dimension and said height dimension; and partition means positioned in said casing and including a divergently tapered imperforate first partition means extending over the full height dimension of said casing and terminating short of the full width dimension of said casing to define a pair of openings proximate opposite side walls of said casing, said first partition means deflecting gases toward side walls of saidcasing, and a convergently tapered second partition means positioned downstream of said first partition means and defining a substantially circular central opening in otherwise imperforate walls for convergence of gases from said side walls to said opening, wherein the improvement in said muffler comprises:*

*said casing having said width dimension and said height dimension respectively substantially constant throughout the length dimension of said casing.*

* * * * *